US006042126A

United States Patent [19]

Müller et al.

[11] Patent Number: 6,042,126

[45] Date of Patent: Mar. 28, 2000

[54] SNOWBOARD AND ANCHORING SYSTEM FOR ATTACHMENT OF A BINDING OF SIMILAR FUNCTION ELEMENT THERETO

[75] Inventors: Gerhard Müller, Straubing; Franz Lindner, Furth im Wald, both of Germany

[73] Assignee: Franz Volkl GmbH & Co., Ski Und Tennis Sportartikelfabrik KG, Germany

[21] Appl. No.: 09/000,845

[22] Filed: Dec. 30, 1997

[30] Foreign Application Priority Data

Jan. 4, 1997 [DE] Germany ..... 197 00 205
Nov. 3, 1997 [DE] Germany ..... 197 48 464

[51] Int. Cl.[7] ..... B62B 9/04; F16B 39/282

[52] U.S. Cl. ..... 280/14.2; 411/187

[58] Field of Search ..... 280/14.2, 607, 280/611, 613, 617, 618, 619, 620; 411/187

[56] References Cited

U.S. PATENT DOCUMENTS 4,747,613 5/1988 Brichoud et al. ..... 280/611
5,221,105 6/1993 Mayr et al. ..... 280/611
5,564,873 10/1996 Ladouceur et al. ..... 411/187
5,609,351 3/1997 Vermillion ..... 280/14.2
5,655,786 8/1997 Raftogianis ..... 280/14.2
5,673,927 10/1997 Vermillion ..... 280/14.2
5,769,445 6/1998 Morrow ..... 280/14.2
5,839,747 11/1998 Gervasoni ..... 280/14.2
5,863,050 1/1999 Meader et al. ..... 280/14.2

*Primary Examiner*—Lanna Mai
*Assistant Examiner*—Jeff Restifo
*Attorney, Agent, or Firm*—Hoffman, Wasson & Gitler

[57] ABSTRACT

A surf-type board, such as a snowboard. Several threaded sleeves which are anchored in the body of the surf-type board and each have an inner thread accessible from the top of the body of the surf-type board, and which form an anchoring system for attachment of a binding or similar function element to the body of the surf-type board, and to an anchoring system for a binding or similar function element to be attached to the top of a surf-type board.

22 Claims, 3 Drawing Sheets

SNOWBOARD AND ANCHORING SYSTEM FOR ATTACHMENT OF A BINDING OF SIMILAR FUNCTION ELEMENT THERETO

BACKGROUND OF THE INVENTION

The invention relates to a surf-type board, such as a snowboard, and to an anchoring system for attachment of function elements to a surf-type board.

Providing threaded sleeves (metal inserts) on snowboards for attachment of the binding is known; the inner thread of the threaded sleeves is accessible on the top of the snowboard body and the respective binding or its components can be screwed onto the inner thread.

The disadvantage with this structure is that the threaded sleeves, for reasons of production, must be inserted in the core of the snowboard before molding with resin in the production of the snowboard body. After completion of the snowboard body, this method necessitates drilling clear at least the threaded holes of the threaded sleeves from the top of the snowboard so that the inner threads are then accessible for screwing on the binding. During the drilling, damage to the threaded sleeves often cannot be avoided. Among other problems, the desired visual appearance of the snowboard suffers. It is a further problem that the inner thread of the threaded sleeve becomes clogged with resin, which then must be removed in a rather involved manner.

The object of the present invention is to devise a surf-type board and an anchoring system for attachment of function elements to a surf-type board which avoids the aforementioned disadvantages. To achieve this object a surf-type board having at least one insert being anchored in the body of the board and being pullout proof from a hole fashioned thereon.

It is a further object of the present invention to provide an anchoring system for a snowboard binding which has at least one insert which is anchored to the snowboard body and is pullout proof and has a threaded hole.

SUMMARY OF THE INVENTION

In the invention it is possible to mount on the snowboard the threaded sleeves in holes which are drilled in the inserts only after completion of the snowboard body, the advantage being that it is no longer necessary to drill clear the threaded sleeves. The danger of damaging these sleeves from the drilling is no longer a problem, nor is removal of resin from the respective inner thread.

Other advantages of the invention lie in the especially strong and reliable anchoring of the threaded sleeves on the body of the surf-type board and in the tight seal of this body against penetration of moisture and water even in the area of the threaded sleeves. Furthermore, the invention offers the possibility of replacement of the threaded sleeves.

In the invention, at least one insert is made of plastic. Other pull out-proof materials are also suitable, for example, materials which guarantee pull-out values or pull-out forces when the surf-type board is being used and which prevent penetration of water and moisture. In particular materials which enable simple subsequent machining, i.e. subsequent drilling of holes (possibly also threaded holes) are suitable, for example, corrosion-resistance metals, such as aluminum or aluminum alloys.

BRIEF DESCRIPTION OF THE DRAWINGS

The invention is detailed in the following using the figures on embodiments.

DETAILED DESCRIPTION OF THE INVENTION

Figure 1:
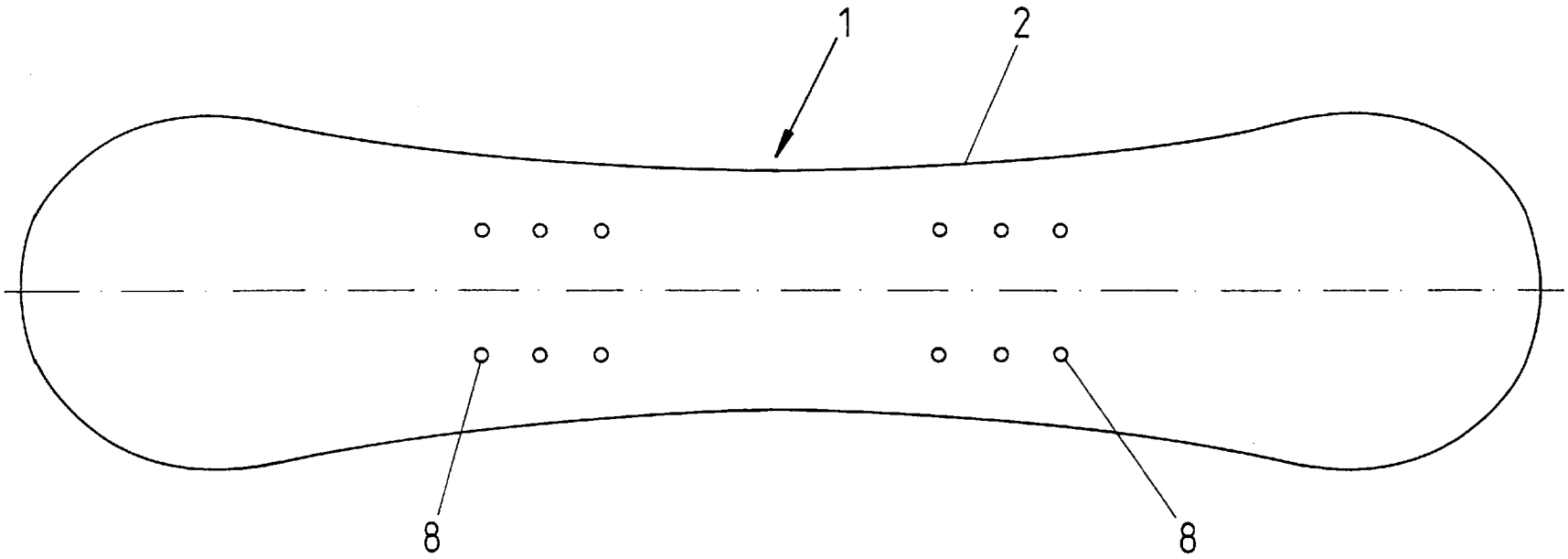
FIG. 1 shows an overhead view of a snowboard in a simplified representation.
Figure 2:
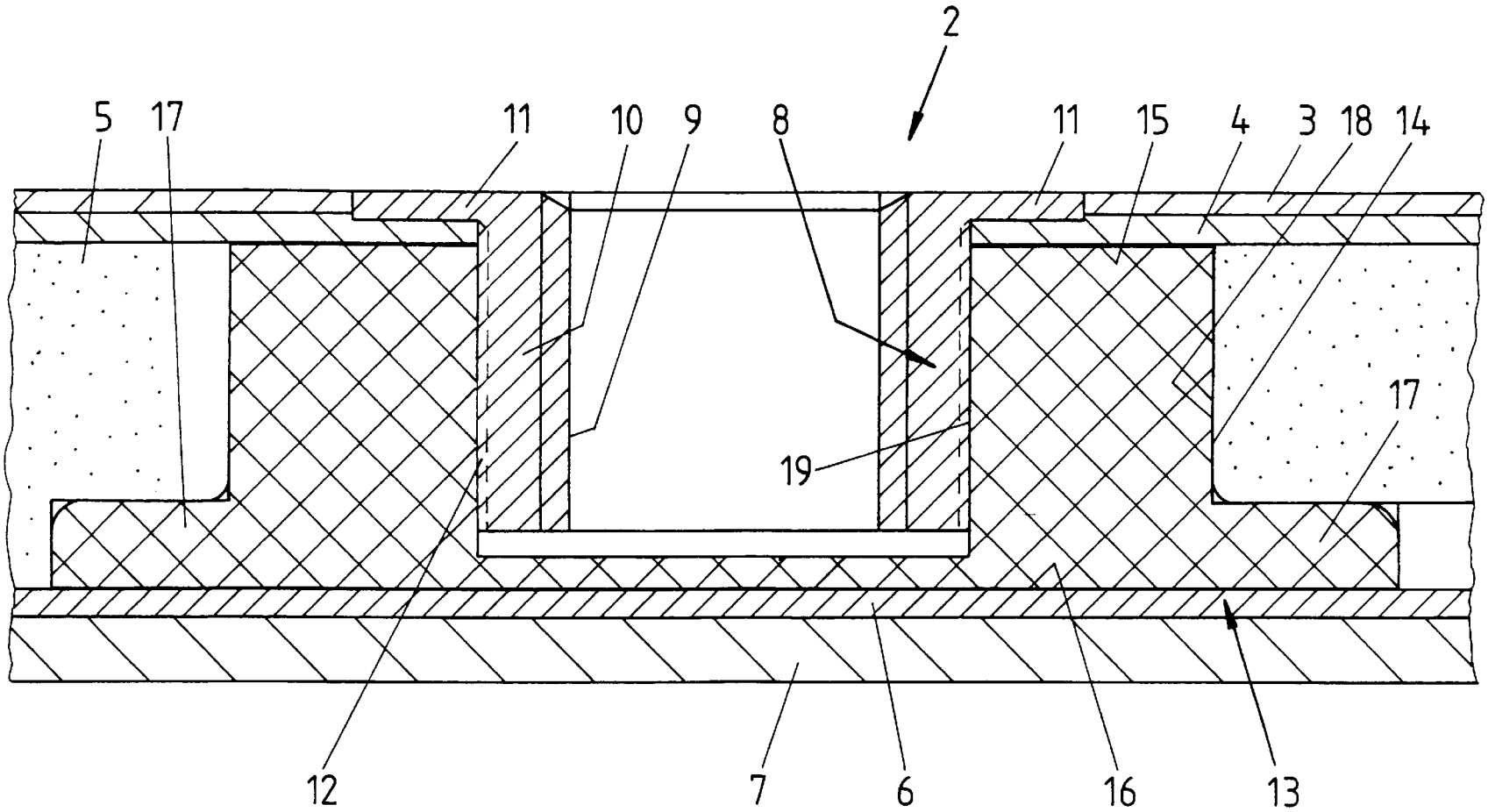
FIG. 2 shows a section through the surf-type board in the area of a metal threaded sleeve for attachment of the binding, in an enlarged partial representation.

In the Figures, 1 labels a snowboard with snowboard body 2 which has the form conventional in snowboards. As FIG. 2 in particular shows, the snowboard body proceeding from its top has the following components which adjoin one another in the sequence shown below in the direction from the top to the bottom of the snowboard body:

Top layer or sealing layer 3 which is for example a colored plastic film which forms the surface of the snowboard;

upper binding piece 4 which extends for example over the entire length and width of snowboard body 2 and which is formed by a fabric of fibers, for example glass fibers and/or plastic fibers and/or carbon fibers, this fabric being embedded in plastic or impregnated with plastic;

wood core 5;

lower binding piece 6 which extends likewise for example over the entire length and width of the snowboard body and which is formed by a fabric of fibers, for example glass fibers and/or plastic fibers and/or carbon fibers, this fabric being embedded in plastic or impregnated with plastic;

a bottom running surface component, of which FIG. 2 shows only running base 7 formed by flat plastic material.

To attach the snowboard binding there is furthermore on snowboard body 2 an anchoring system which has a plurality of inserts or threaded sleeves 8 which are anchored in snowboard body 2 and which consist of a corrosion resistant metal, specifically high-grade steel. Threaded sleeves 8 have an inner thread 9 which has axis A perpendicular to the plane of the snowboard body and which is accessible from the top of snowboard body 2.

FIG. 2 shows the construction of threaded sleeves 8 and their anchoring to snowboard body 2 in more detail. Each threaded sleeve 8 has sleeve-like body 10 which is open on both ends and which has inner thread 9. On one end, body 10 is provided with a flange or collar 11, which stands radially away above the peripheral surface of this body. Body 10 has thread 12 which displaces material on the outer or peripheral surface.

Each threaded sleeve 8 is held in outer insert 13 (See FIG. 5) which is produced from a suitable tough plastic. In this embodiment, the outer insert is a solid part formed rotationally symmetrical around axis A with circular cylindrical peripheral surface 14, with flat circular faces 15, 16, which are each perpendicular to axis A and with a collar 17 which stands radially away above cylinder surface 14 on one end or face 16.

The insert 13 is inserted into a matched hole 18 in the core 5 from the bottom of the core such that the larger face 16 on the collar 17 is level with the bottom or the core 5 adjacent to the binding piece 6. The lower face 16 is joined or cemented over its entire surface to the lower binding piece 6. The upper face 15 is level with the top of the core 5 adjacent to the binding piece 4 and is joined or cemented over its entire surface to the upper binding piece 4, on which the cover layer 3 is attached over its entire surface.

The holes 18 for the inserts 13 are drilled into the core 5 in a stipulated pattern (relative to the stipulated reference edges) so that the inserts 13 are also provided in the completed snowboard in this pattern. For insertion of the threaded sleeves, the core holes 19 are drilled into the inserts 13 through the top layer 3 and the binding piece 4 from overhead, such that the depth of each hole 19 is less than the axial height of the inserts 13, each hole 19 therefore ends at a distance above the lower face 16. Then, the threaded sleeve 8 is screwed into the respective core hole 19 and with its material-displacing the outer thread 12 forms the corresponding thread in the wall of the core hole 19. By using the material-displacing threads 12, material compression causes especially strong anchoring of the threaded sleeves 8 in the respective insert 13. The threaded sleeves 8 are screwed in such that the side of the collar 11 facing away from the remaining threaded sleeve is flush with the top of the snowboard or the top layer 8. The respective collar 11 yields a tight and optically unobjectionable transition between the respective threaded sleeve 8 and the adjacent top layer 3. Since the location of the plastic insert 13 is known, it is easy to drill the core holes 19, for example, with a computer-controlled drilling tool. Then, the screws for attachment of the snowboard binding can be screwed into the inner thread 9 of the threaded sleeves 8.

The described anchoring system has a number of advantages, specifically, among others:

The plastic insert 13 yields a strong and reliable anchoring of the threaded sleeves 8 in the snowboard body 2. Using plastic inserts, ensures that the core 5 is sealed against penetrating moisture. Wherever there are threaded sleeves 8, no moisture can penetrate into the material of core 5, especially along the peripheral surface of the respective threaded sleeve 8. Since the diameter of the plastic insert 13 is already larger in the area of the smaller face 15 than the outside diameter of the threaded sleeves 8, i.e. in the embodiment shown the diameter of the plastic insert 13 in the area of the cylindrical peripheral surface 14 is roughly twice the outside diameter of body 10 of threaded sleeves 8, secure anchoring and tight sealing also prevail even if the respective core hole 19 is not drilled exactly with its axis identical to the axis A. The inner thread 9 of the respective threaded sleeves 8 is freely accessible and is not clogged by residual resin by screwing threaded sleeves 8, only after completion of the snowboard body 2, into the core holes 19 which are also drilled in the snowboard body 2 after its completion.

Furthermore, for temperature purposes it is possible to screw the respective threaded sleeve 8 out of the respective plastic insert and to replace it by another threaded sleeve 8. Threaded sleeve 8 can be screwed in and out by using a screw with a lock nut, the screw screwed into inner thread 9.

Using the individual plastic inserts 13 which, wherever they are provided in snowboard body 2, make up only a fraction of the snowboard body volume, ensures that the properties of the snowboard, such as flexibility, etc., are not adversely affected by their inclusion.

Figure 3:
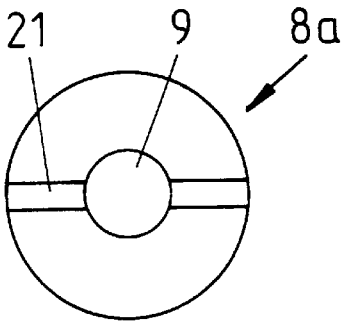
FIG. 3 shows an overhead view of a further embodiment of the metal threaded sleeve for use in the anchoring system.
Figure 4:
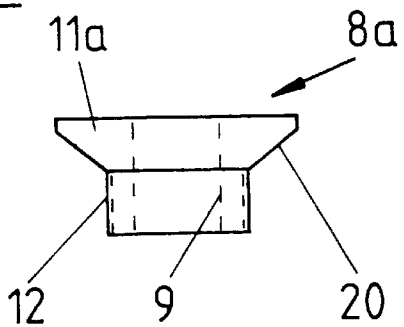
FIG. 4 shows a side view of the further embodiment of the metal threaded sleeve depicted in FIG. 3.

FIGS. 3 and 4 show as another possible embodiment of the threaded sleeve 8a which differs from threaded sleeve 8 only in that the bottom of collar 11*a* is beveled on the transition to body 10 at incline 20 in the manner of a flathead bolt, so that this collar 11*a* meshes with the material of top layer 3 and binding piece 4 when threaded sleeve 8*a* is screwed into the core hole 19, so that in the production of the core hole 19 "countersinking" to accommodate the flange 11*a* can for the most part be abandoned. Furthermore, the threaded sleeve 8*a*, on the face of the collar 11*a*, pointing from sleeve body 10, is provided with a slot 21 with which the threaded sleeve 8*a* can be screwed in and out using a screwdriver.

Snowboard body 2 is produced such that the first of all the holes 18 for the inserts 13 are drilled in wood core 5. Then the inserts 13 are inserted into these holes such that the lower faces 16 are flush with the bottom of the core 5. The axial length of the plastic inserts 13 is selected such that they project with their other end somewhat above the top of the core 5. Then the core 5 on the top is ground flat so that the faces 15 are obtained which are level with the top of the core 5. At this point, the conventional attachment of the binding pieces 5 and 6, the top layer 3, and the running base 7, takes place by molding with a synthetic resin, an auxiliary layer being optionally applied beforehand at least to the faces 15 and 16, of the plastic inserts 13, and ensuring the joining of the plastic material of this insert 13 to the synthetic resin used in the production of the snowboard body 2.

Figure 5:
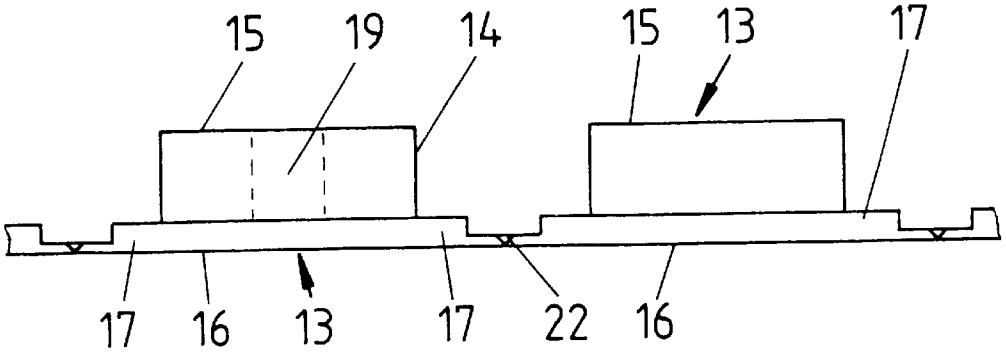
FIG. 5 shows in a simplified representation several plastic inserts joined to one another by binding pieces for use in the anchoring system as claimed in the invention.

FIG. 5 schematically shows one embodiment in which the individual plastic inserts 13 are joined to one another via binding pieces formed by molded-on material bridges 22. In this way, installation of the inserts 13 on the core 5 can be facilitated. The material bridges 22, which are located in the area of the respective collar 17, are either retained after mounting and for this reason held by groove-shaped depressions which are formed on the bottom of core 5, or the material bridges 22 are removed after inserting the insert 13 into the respective hole 18, for example, by grinding the core 5 flat on the bottom.

The invention was described above by the preceding embodiments. Numerous alterations and modifications are possible without departing from the inventive idea underlying the invention.

Reference Number List

1 snowboard
2 snowboard body
3 top layer
4 binding piece
5 core
6 binding piece
7 running base
8, 8*a* threaded sleeve
9 inner thread
10 body
11, 11*a* collar
12 outer thread
13 inset
14 peripheral surface
15, 16 face
17 collar
18 hole
19 core hole
20 bevel
21 slot
22 material bridge

What is claimed is:

1. A surf-type board having at least one threaded sleeve which is anchored to body of said surf-type board and which has an inner thread accessible from a top of said body of said surf-type board, and an anchoring system for attachment of a binding or binding element to said body of said surf-type board, said system comprising at least one insert which is anchored in said body of said surf-type board, said at least one insert is made of a pull out-proof material, said at least one insert having at least one hole in which at least one threaded sleeve is anchored, and wherein said at least one threaded sleeve is anchored by profiling which is provided on said outer surface of said at least one threaded sleeve by an outside thread in a hole of said at least one insert.

2. The surf-type board according to claim 1, wherein said insert is anchored to said body in a core on said body.

3. The surf-type board as claimed in claim 1, wherein said insert is made of a plastic or a corrosion-resistant material.

4. The surf-type board as claimed in claim 3, wherein said corrosion-resistant material is aluminum or an aluminum alloy.

5. The surf-type board as claimed in claim 1, wherein each said at least one threaded sleeve has its own insert.

6. The surf-type board as claimed in claim 1, wherein said at least one insert is joined by material bridges for accommodating said at least one threaded sleeve.

7. The surf-type board as claimed in claim 1, wherein said at least one insert on a side facing a bottom of said surf-type board has an enlarged cross section.

8. The surf-type board as claimed in claim 7, wherein said enlarged cross section has a collar which stands away above a peripheral surface of said at least one insert.

9. The surf-type board as claimed in claim 1, wherein said at least one insert has a diameter which is much greater than an outside diameter of said at least one threaded sleeve.

10. The surf-type board as claimed in claim 1, wherein said outside thread of said at least one threaded sleeve is a self-tapping thread or a material-displacing thread.

11. The surf-type board as claimed in claim 1, wherein said at least one insert is produced as a solid body from a pull-out proof material.

12. An anchoring system for a binding or binding element to be attached to a top of a surf-type board, comprising at least one with threaded sleeve which is anchored in a body of said surf-type board and which each sleeve has an inner thread which is accessible from a top of said body of said surf-type board, wherein at least one insert which is anchored in said body of said surf-type board, said at least one insert is made of a pull out-proof material, said at least one insert having at least one hole in which said at least one threaded sleeve is anchored, and wherein said at least one threaded sleeve is anchored by profiling which is provided on said outer surface of said at least one threaded sleeve by an outside thread in a hole of said at least one insert.

13. The anchoring system as claimed in claim 12, wherein said insert is anchored to said body in a core on said body.

14. The anchoring system as claimed in claim 12, wherein said insert is made of a plastic or a corrosion-resistant material.

15. The anchoring system as claimed in claim 14, wherein said corrosion-resistant material is aluminum or an aluminum alloy.

16. The anchoring system as claimed in claim 12, wherein each said at least one threaded sleeve has its own insert.

17. The anchoring system as claimed in claim 12, wherein said at least one insert is joined by material bridges for accommodating said at least one threaded sleeve.

18. The anchoring system as claimed in claim 12, wherein said at least one insert on a side facing a bottom of said surf-type board has an enlarged cross section.

19. The anchoring system as claimed in claim 18, wherein said enlarged cross section has a collar which stands away above a peripheral surface of said at least one insert.

20. The anchoring system as claimed in claim 12, wherein said at least one insert has a diameter which is much greater than an outside diameter of said at least one threaded sleeve.

21. The anchoring system as claimed in claim 12, wherein said outside thread of said at least one threaded sleeve is a self-tapping thread or a material-displacing thread.

22. The anchoring system as claimed in claim 12, wherein said at least one insert is produced as a solid body from a pull-out proof material.

* * * * *